US009249620B2

(12) United States Patent
Kim

(10) Patent No.: US 9,249,620 B2
(45) Date of Patent: Feb. 2, 2016

(54) ROLL BLIND

(75) Inventor: Sung Chul Kim, Incheon (KR)

(73) Assignee: Sung Chul Kim, Incheon (KR)

( * ) Notice: Subject to any disclaimer, the term of this patent is extended or adjusted under 35 U.S.C. 154(b) by 1093 days.

(21) Appl. No.: 12/672,106

(22) PCT Filed: Nov. 17, 2008

(86) PCT No.: PCT/KR2008/006759

§ 371 (c)(1),
(2), (4) Date: Feb. 4, 2010

(87) PCT Pub. No.: WO2009/136683

PCT Pub. Date: Nov. 12, 2009

(65) Prior Publication Data

US 2011/0061821 A1 Mar. 17, 2011

(30) Foreign Application Priority Data

May 7, 2008 (KR) ..... 10-2008-0042415

(51) Int. Cl.

| | |
|---|---|
| ***A47H 1/00*** | (2006.01) |
| ***E06B 9/40*** | (2006.01) |
| ***E06B 9/264*** | (2006.01) |
| *E06B 9/24* | (2006.01) |

(52) U.S. Cl.

CPC . *E06B 9/40* (2013.01); *E06B 9/264* (2013.01); *E06B 2009/2405* (2013.01); *E06B 2009/2458* (2013.01); *E06B 2009/405* (2013.01)

(58) Field of Classification Search

CPC ..... E06B 9/40; E06B 9/262; E06B 2009/405; E06B 2009/2405; E06B 2009/2458

USPC ..... 160/120, 238, 241, 309, 312, 320, 321, 160/86, 89, 85, 88, 315, 317, 323.1; 192/223.4, 41 S

See application file for complete search history.

(56) References Cited

U.S. PATENT DOCUMENTS

| | | | | | |
|---|---|---|---|---|---|
| 2,581,433 | A | * | 1/1952 | North et al. | 160/120 |
| 3,128,688 | A | * | 4/1964 | Coda | 396/3 |
| 3,135,369 | A | * | 6/1964 | Nisenson et al. | 192/223.4 |
| 3,789,904 | A | * | 2/1974 | Takazawa | 160/120 |
| 3,853,170 | A | * | 12/1974 | Barettella | 160/323.1 |
| 3,980,122 | A | * | 9/1976 | Takazawa | 160/85 |
| 4,020,889 | A | * | 5/1977 | Karoll | 160/120 |
| 4,418,739 | A | * | 12/1983 | Woolnough et al. | 160/120 |
| 4,583,517 | A | * | 4/1986 | Hilton et al. | 126/502 |
| 5,139,075 | A | * | 8/1992 | Desrochers | 160/310 |
| 5,538,065 | A | * | 7/1996 | G eraud | 160/85 |

(Continued)

FOREIGN PATENT DOCUMENTS

| | | | | |
|---|---|---|---|---|
| JP | 10176471 A | * | 6/1998 | E06B 9/56 |
| WO | WO 2008/004805 | * | 1/2008 | |

*Primary Examiner* — Katherine Mitchell
*Assistant Examiner* — Johnnie A Shablack
(74) *Attorney, Agent, or Firm* — Renner, Otto, Boisselle & Sklar, LLP

(57) ABSTRACT

A roll blind is provided which can guarantee a simple operation. The roll blind includes: a supporting frame disposed in a window frame; first and second winding bars rotatably disposed in the supporting frame; a winding driver rotationally driving one of the first and second winding bars; first and second screens coupled to the first and second winding bars, respectively; a weight bar to which the tower ends of the first and second screens are fixed; and a clutch unit binding and unbinding the first and second winding bars with respect to each other.

11 Claims, 7 Drawing Sheets

(56) References Cited

U.S. PATENT DOCUMENTS

| | | | | |
|---|---|---|---|---|
| 5,727,664 | A * | 3/1998 | Chico | 188/382 |
| 6,029,735 | A * | 2/2000 | Nicholson | 160/321 |
| 6,189,592 | B1 * | 2/2001 | Domel | 160/85 |
| 6,257,305 | B1 * | 7/2001 | Mullet et al. | 160/310 |
| 6,279,639 | B1 * | 8/2001 | Schlecht et al. | 160/23.1 |
| 6,749,000 | B2 * | 6/2004 | Bohlen | 160/321 |
| 7,025,298 | B2 * | 4/2006 | Priest et al. | 242/388.8 |
| 7,267,156 | B2 * | 9/2007 | Byeon | 160/121.1 |
| 7,849,907 | B2 * | 12/2010 | Jang | 160/86 |
| 8,025,088 | B2 * | 9/2011 | Kim | 160/120 |
| 2007/0084568 | A1 * | 4/2007 | Nien | 160/85 |
| 2008/0190569 | A1 * | 8/2008 | Jang | 160/127 |
| 2009/0173454 | A1 * | 7/2009 | Cheng | 160/120 |

* cited by examiner

ROLL BLIND

This application is a national phase of International Application No. PCT/KR2008/006759 filed Nov. 17, 2008 and published in the English language.

TECHNICAL FIELD

The present invention relates to a roll blind, and more particularly, to a roll blind that can guarantee a simple operation.

BACKGROUND ART

A roll blind serves to block light beams, block external sight, absorb sounds, protect against the hot, and protect against the cold by downward unwinding or winding a screen in a roll shape. In addition to the practical use, the roll blind also serves to soften the hardness of a wall or glass and improve an interior beautiful sight by combinations of colors.

On the other hand, the known roll blind cannot properly adjust the intensity of light input from the outside by downward unwinding or winding the screen, and it is thus difficult to adjust the brightness.

Accordingly, a roll blind that can easily adjust the brightness was suggested in recent years. Examples of such a roll blind having a brightness adjusting function are disclosed in Korean Utility Model Registration Nos. 20-365028 and 20-0279166.

In such roll blinds having the brightness adjusting function, a transparent portion and an opaque portion are alternately arranged on the surface of a screen, the transparent portion and the opaque portion are formed in a stripe pattern, and the front transparent portions and the rear opaque portions are made to overlap with each other to adjust the intensity of light input from the outside, thereby adjusting the brightness.

However, the known roll blinds having the brightness adjusting function take much time for unwinding or winding a screen and are troublesome in operation, thereby deteriorating the convenience of use.

The known roll blinds having the brightness adjusting function do not guarantee the straightness of the stripe lines of the transparent portions and the opaque portions. Accordingly, the stripe lines of the transparent portions and the opaque portions overlapping with each other may be inclined to one side or curved to both sides, thereby damaging the external appearance.

DISCLOSURE OF INVENTION

Technical Problem

The invention is contrived to solve the above-mentioned problems. An advantage of the invention is to provide a roll blind that can greatly enhance the convenience of use by enabling rapid and simple unwinding and winding operations of a screen.

Another advantage of the invention is to provide a roll blind that can improve the external appearance by enhancing the straightness of the stripe lines of transparent portions and opaque portions in a screen.

Technical Solution

According to an aspect of the invention, there is provided a roll blind including: a supporting frame disposed in a window frame and having a pair of end plates disposed at both ends;

first and second winding bars rotatably disposed in the end plates of the supporting frame; a winding driver rotationally driving one of the first and second winding bars; first and second screens coupled to the first and second winding bars, respectively; a weight bar to which the lower ends of the first and second screens are fixed; and a clutch unit binding and unbinding the first and second winding bars with respect to each other.

Here, the clutch unit includes a driving gear fixedly coupled to the winding driver and a driven gear disposed to be bound to and unbound from the second winding bar.

An intermediate gear is interposed between the driving gear and the driven gear.

The driven gear has an arc-like clutch groove formed in one surface thereof, the clutch groove has both end portions, the second winding bar has a clutch protrusion, and the driven gear is selectively bound to or unbound from the second winding bar by guiding the clutch protrusion in the clutch groove and bringing the clutch protrusion into selective contact with both end portions of the clutch groove.

The winding driver may be disposed at one end of the first winding bar, the winding driver may rotate along with the first winding bar, the winding driver may include a small-diameter portion and a large-diameter portion, the small-diameter portion may be inserted and coupled to the inner circumference of the first winding bar, and a driving string may be wound on the outer circumferential surface of the large-diameter portion.

A rotating member may be disposed in one inner circumference of the second winding bar, the rotating member may rotate along with the second winding bar, a fixed member may be disposed inside the rotating member, and the fixed member may rotatably support the rotating member.

An elastic member providing elastic force in a circumferential direction to the rotating member may be disposed between the rotating member and the fixed member.

The rotating member may include first and second rotating members, the second rotating member may be inserted into the first rotating member, and the elastic member may include a torsion portion wound on the outer circumferential surface of the fixed member and elastic legs disposed at both ends of the torsion portion and contactable with the second rotating member.

The clutch unit may include a driving gear fixedly coupled to the winding driver and a driven gear disposed to be bound to and unbound from the second winding bar. The driving gear may be fixedly coupled to the winding driver, the driven gear may have a clutch groove formed in the circumferential direction in one surface thereof, the clutch groove may have both end portions, the second rotating member may have a clutch protrusion, and the driven gear may be selectively bound to or unbound from the second winding bar by guiding the clutch protrusion in the clutch groove and bringing the clutch protrusion into selective contact with both end portions of the clutch groove.

Advantageous Effects

According to the above-mentioned configurations, since the first and second screens are wound on and unwound from the first and second winding bars, respectively, it is possible to rapidly and simply wind and unwind the screen.

According to the above-mentioned configurations, since a screen is divided into the first screen and the second screen, it is possible to precisely improve the straightness of the stripe lines of the transparent portions and the opaque portions of the screens, thereby improving the external appearance thereof.

MODE FOR THE INVENTION

Figure 1:
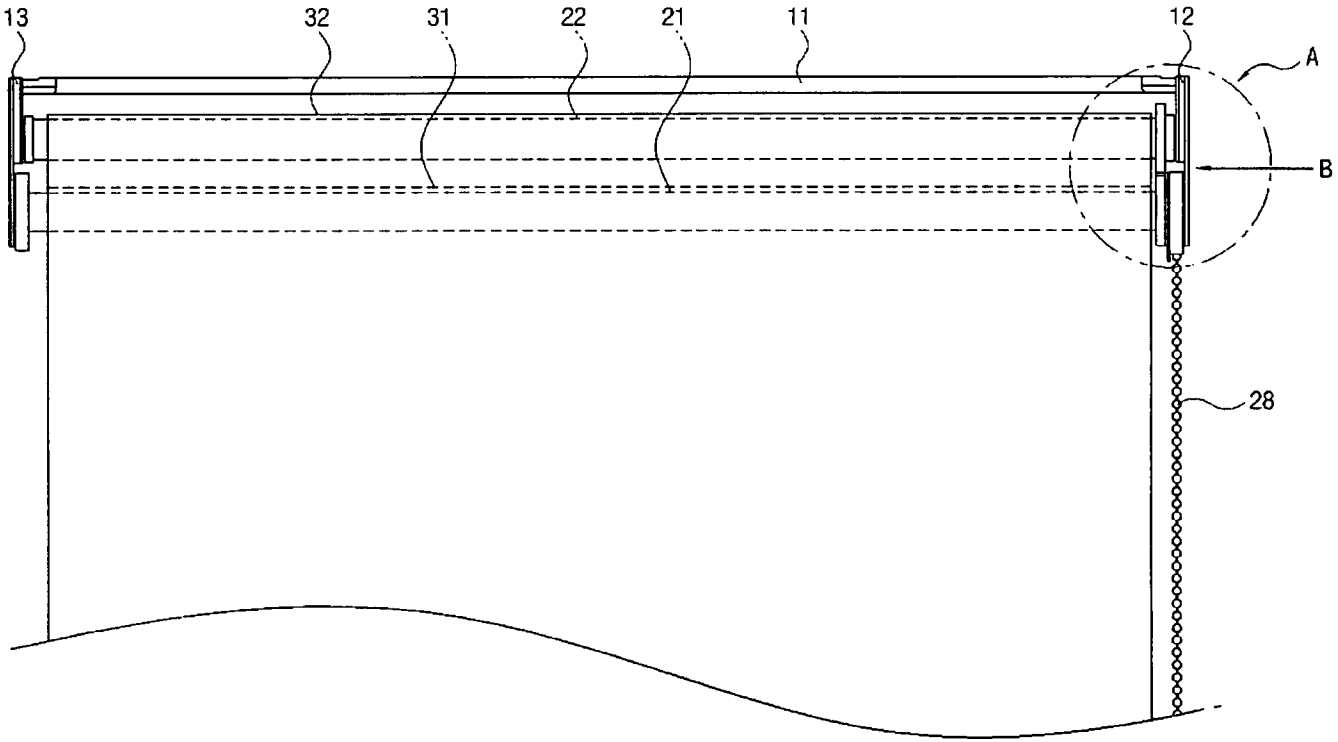
FIG. 1 is a front view illustrating a roll blind according to an embodiment of the invention.
Figure 2:
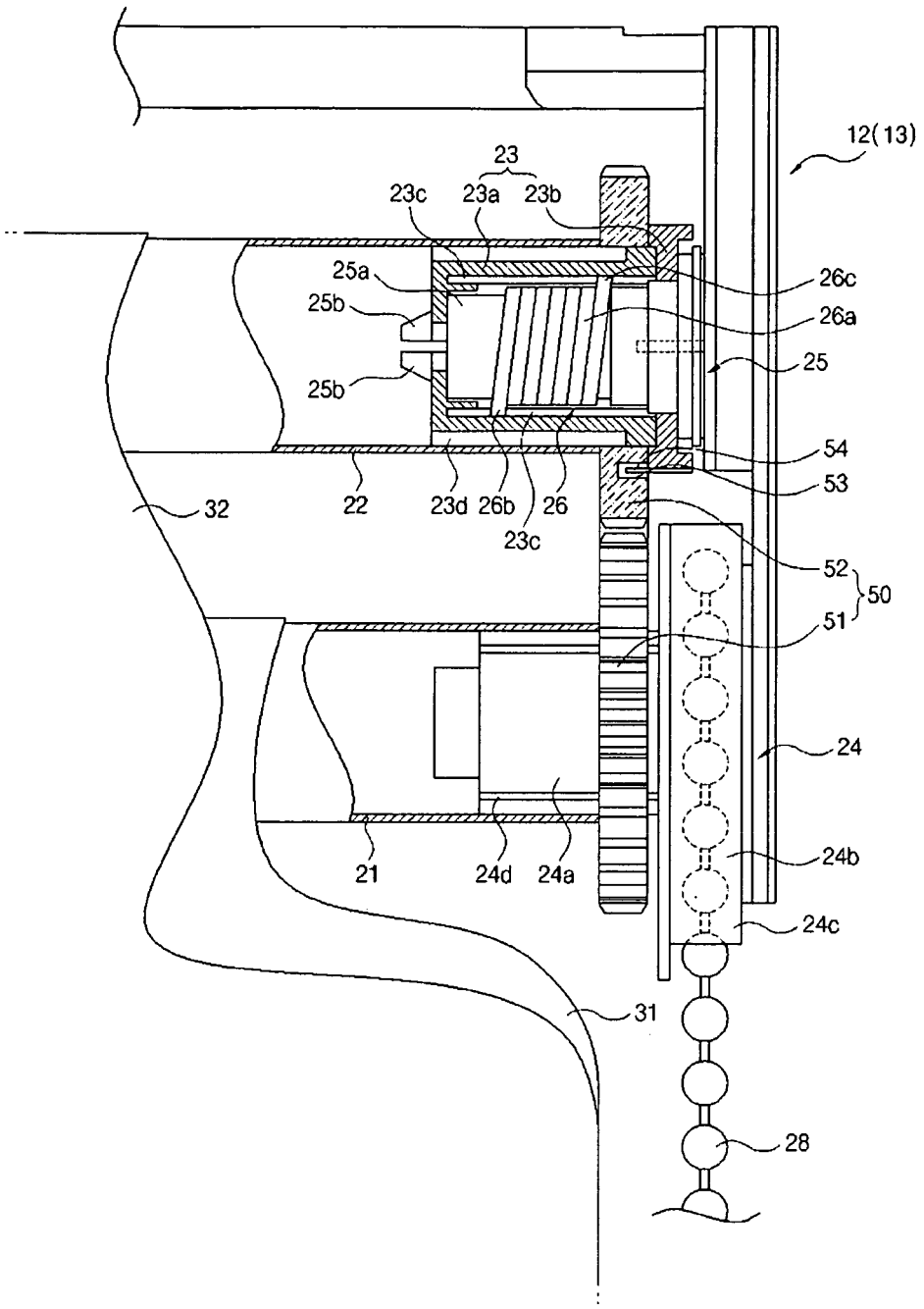
FIG. 2 is a partial sectional view illustrating the part of arrow A in FIG. 1.
Figure 3:
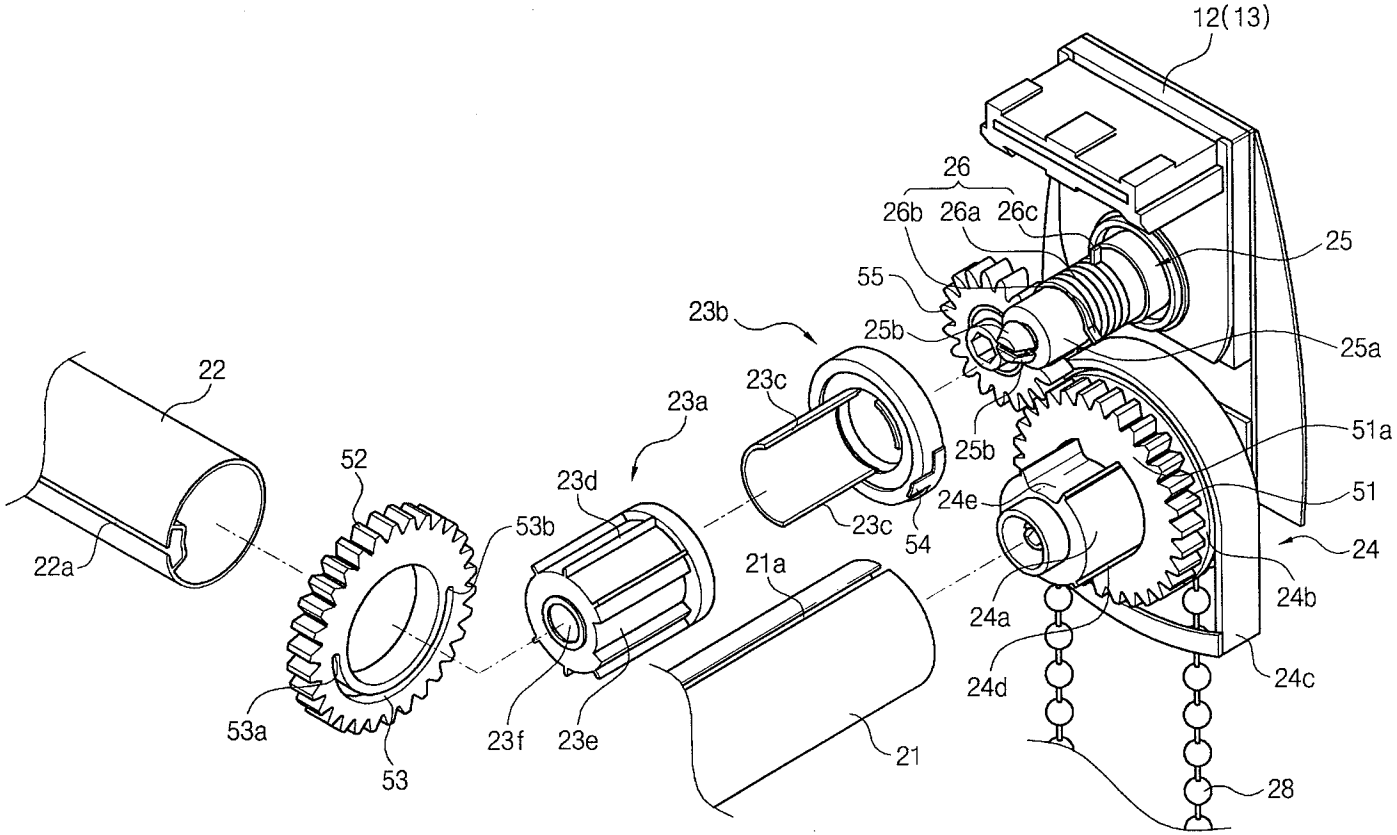
FIG. 3 is an exploded perspective view illustrating constituent elements of FIG. 2.

Hereinafter, exemplary embodiments of the invention will be described in detail with reference to the accompanying drawings.

FIGS. 1 to 7 show a roll blind according to an embodiment of the invention.

As shown in the drawings, the roll blind according to the embodiment of the invention includes a supporting frame 11 disposed in a window frame or the like, first and second winding bars 21 and 22 rotatably disposed in the supporting frame 11, first and second screens 31 and 32 coupled to the first and second winding bars, respectively, a weight bar 40 to which the lower ends of the first and second screens 31 and 32 are fixed, and a clutch unit 50 binding and unbinding the first and second winding bars 21 and 22 with respect to each other.

The supporting frame 11 has a length corresponding to the width of a window and a pair of end plates 12 and 13 is disposed at both ends thereof.

The first and second winding bars 21 and 22 are rotatably disposed in the pair of end plates 12 and 13. The first and second winding bars 21 and 22 have on the outer circumferential surfaces attachment grooves 21*a* and 22*a* to which the upper ends of the first and second screens 31 and 32 are individually coupled, respectively.

An end of the first winding bar 21 is disposed in one end plate 12 via a winding driver 24. The winding driver 21 is disposed to rotate along with the first winding bar 21. The winding driver 24 is rotatably supported by one end plate 12 and the other end of the first winding bar 21 is rotatably supported by the other end plate 13.

The winding driver 24 has a small-diameter portion 24*a* and a large-diameter portion 24*b*. The small-diameter portion 24*a* protrudes from the large-diameter portion 24*b*. The small-diameter portion 24*a* of the winding driver 24 is inserted and coupled into the inner circumference of the first winding bar 21, whereby the winding driver 24 and the first winding bar 21 rotate together. Plural insertion ribs 24*d* and an insertion groove 24*e* are formed in the outer circumferential surface of the small-diameter portion 24*a*. An insertion groove 21*a* of the first winding bar 21 is inserted into the insertion groove 24*e* and the plural insertion ribs 24*d* come in frictional contact with the inner circumferential surface of the first winding bar 21.

A driving string 28 is wound on the outer circumferential surface of the large-diameter portion 24*b* of the winding driver 24. The winding driver 24 rotates clockwise and counterclockwise by pulling the driving string 28. The outer circumferential surface of the large-diameter portion 24*b* is covered with a cover 24*c*.

A rotating member 23 is disposed in the inner circumference of the second winding bar 22. The rotating member 23 rotates along with the second winding bar 22. A fixed member 25 is disposed in the rotating member 23 to rotationally support the rotating member 23. One end of the fixed member 25 is fixed to one end plate 12 and the other end of the fixed member 25 is provided with a protruding portion 25*a*. Two or more elastic coupling protrusions 25*b* that can be elastically narrowed or widened are formed at the end of the protruding portion 25*a*. The rotating member 23 is rotatably coupled to the fixed member 25 by coupling the elastic coupling protrusions 25*b* to an assembling hole 23*f* of the rotating member 23. The other end of the second winding bar 22 is rotatably supported by the other end plate 13.

On the other hand, the rotating member 23 includes first and second rotating members 23*a* and 23*b*. The second rotating member 23*b* is inserted into the first rotating member 23*a*.

The outer circumferential surface of the first rotating member 23*a* is inserted into the inner circumference of the second winding bar 22. Plural insertion ribs 23*d* and an insertion groove 23*e* are formed in the outer circumferential surface of the first rotating member 23*a*. An insertion groove 22*a* of the second winding bar 22 is inserted into the insertion groove 23*e* and the plural insertion ribs 23*d* come in frictional contact with the inner circumferential surface of the second winding bar 22.

A clutch protrusion 54 may be disposed on one side of the outer circumferential surface of the second rotating member 23*b*. The second rotating member 23*b* has a supporting wall 23*c* protruding to one side. The supporting wall 23*c* is inserted into the first rotating member 23*a*. The supporting wall 23*c* has an arc-like sectional shape.

An elastic member 26 providing circumferential elastic force to the first rotating member 23*a* is disposed between the rotating member 23 and the fixed member 25. The circumferential elastic force is given to the first rotating member 23*a* in the rotation direction by the elastic member 26 and thus the second winding bar 22 and the first rotating member 23*a* are coupled to each other with greater coupling force in the rotation direction. In the embodiment, a torsion spring 26 is exemplified as the elastic member 26. The torsion spring 26 includes a torsion portion 26*a* wound on the outer circumferential surface of the protruding portion 25*a* of the fixed member 25*f* and elastic legs 26*b* and 26*c* formed at both ends of the torsion portion 26*a*. The elastic legs 26*b* and 26*c* of the torsion spring 26 come in contact with the ends of the supporting wall 23*c* of the second rotating member 23*b* and the opposite elastic force in the circumferential direction is applied to the elastic legs 26*b* and 26*c*.

Plural transparent portions 33 and plural opaque portions 35 are alternately and continuously arranged in the first and second screens 31 and 32 and each transparent portion 33 and each opaque portion 35 have the same width and height. The transparent portions 33 and the opaque portions 35 are formed in a stripe pattern.

The lower ends of the first and second screens 31 and 32 are individually coupled to the weight bar 40. The first and second screens 31 and 32 can keep the unwound state in the direction of gravitational force constant by the use of the weight bar 40.

A coupling member 31*a* is fixed to the upper end of the first screen 31. The first coupling member 31*a* of the first screen 31 is inserted and coupled into the insertion groove 21*a* of the first winding bar 21 and the lower end of the first screen 31 is coupled to the weight bar 40.

A coupling member 32*a* is fixed to the upper end of the second screen 32. The first coupling member 32*a* of the second screen 32 is inserted and coupled into the insertion groove 22*a* of the second winding bar 22 and the lower end of the second screen 32 is coupled to the weight bar 40.

The clutch unit 50 allows the first and second winding bar 21 and 22 to rotate at the same time or allows only one of the first and second winding bars 21 and 22 to selectively rotate, by mutually binding or unbinding the first and second winding bars 21 and 22.

The clutch unit 50 according to an embodiment includes a driving gear 51 fixedly coupled to the first winding bar 21 and a driven gear 52 disposed to be bound to and unbound from the second winding bar 22.

The driving gear 51 has a coupling protrusion 51*a* in its inner circumference. By inserting the coupling protrusion 51*a* into the insertion groove 24*e* of the winding driver 24, the driving gear 51 is fixedly disposed in the winding driver 24, whereby the driving gear 51 rotates along with the first winding bar 21.

The driven gear 52 is rotatably disposed between the second winding bar 22 and the rotating member 23. The driven gear 52 is disposed to be bound to and unbound from the second winding bar 22, whereby the driven gear 52 can rotate along with the second winding bar or independent of the second winding bar 22.

The driven gear 52 has an arc-like clutch groove 53 formed in one surface thereof and the clutch groove 53 has both end portions 53*a* and 53*b*. A clutch protrusion 54 protrudes from one side of the second winding bar 22 toward the clutch groove 53 and the clutch protrusion 54 is guided in the clutch groove 53. The driven gear 52 and the second winding bar 22 are connected to each other to be mutually bound and unbound by the clutch groove 53 and the clutch protrusion 54. On the other hand, in this embodiment, the clutch protrusion 54 may be fixedly installed on the outer circumferential surface of the second rotating member 23*b*, which rotates along with the second winding bar 22, with a coupling mechanism or an adhesive.

Accordingly, with the rotation of the driven gear 52, the clutch protrusion 54 is guided in the clutch groove 53. When the clutch protrusion 54 comes in contact with the end portions 53*a* and 53*b* of the clutch groove 53, the driven gear 52 and the second winding bar 22 can rotate together in the same direction while maintaining the bound state.

A circumferential portion a of the clutch groove 53 is a section where the driven gear 52 rotates independent of the second winding bar 22 (that is, a section where the driven gear 52 is not bound (unbound) to the second winding bar 22). In the circumferential portion a of the clutch groove 53, since only the first winding bar 21 can rotate clockwise or counterclockwise, the transparent portions 33 and the opaque portions 35 of the first and second screens 31 and 32 intersect each other, whereby the intensity of light input from the outside can be adjusted to adjust the brightness. That is, the circumferential portion a of the clutch groove 53 is set to a section for adjusting the brightness.

On the other hand, in the clutch unit 50 according to an embodiment, an intermediate gear 55 may be interposed between the driving gear 51 and the driven gear 52, whereby the driving gear 51 and the driven gear 52 rotate in the same rotation direction. The intermediate gear 55 is disposed close to one end plate 12 and the end plate 12 may further have an extra installation hole 12*a* for installing the intermediate gear 55 to correspond to the change in installation position of the intermediate gear 55.

On the other hand, in the clutch unit 50 according to another embodiment, the driving gear 51 and the driven gear 52 may be made to directly engage with each other without interposing the intermediate gear 55 between the driving gear 50 and the driven gear 52, whereby the driving gear 51 and the driven gear 52 rotate in the opposite rotation directions.

The operation of the clutch unit 50 having the above-mentioned configuration is as follows.

When the winding driver 24 rotates clockwise or counterclockwise by pulling the driving string 28, the driving gear 51 rotates in the same direction as the winding driver 24 and thus the driven gear 52 rotates in the same direction as the driving gear 51 via the intermediate gear 55. On the other hand, when the intermediate gear 55 is not disposed, the driven gear 52 rotates in the opposite direction of the driving gear 51.

When the driven gear 52 rotates and the clutch protrusion 54 is being guided in the circumferential portion a of the clutch groove 53, the driven gear 52 is not coupled to the second winding bar 22 (that is, the driven gear 52 is not bound to the second winding bar 22) and thus the second winding bar 22 does not rotate.

Thereafter, when the clutch protrusion 54 comes in contact with any of both end portions 53*a* and 53*b* of the clutch groove 53, the second winding bar 22 is bound to the driven gear 52 and thus the second winding bar 22 and the driven gear 52 rotate in the same direction.

Accordingly, the first and second winding bars 21 and 22 can rotate together by the contact between the clutch groove 53 and the clutch protrusion 54 of the clutch unit 50. Then, the first and second screens 31 and 32 go up or down together and are wound on the first and second winding bars 21 and 22 or unwound from the first and second winding bars 21 and 22.

That is, since the first and second screens 31 and 32 are wound on or unwound from the first and second winding bars 21 and 22 at the same time, it is possible to very rapidly and simply perform the winding and unwinding operations of the screens 31 and 32.

The entire operation of the invention will be described now.

Figure 4:
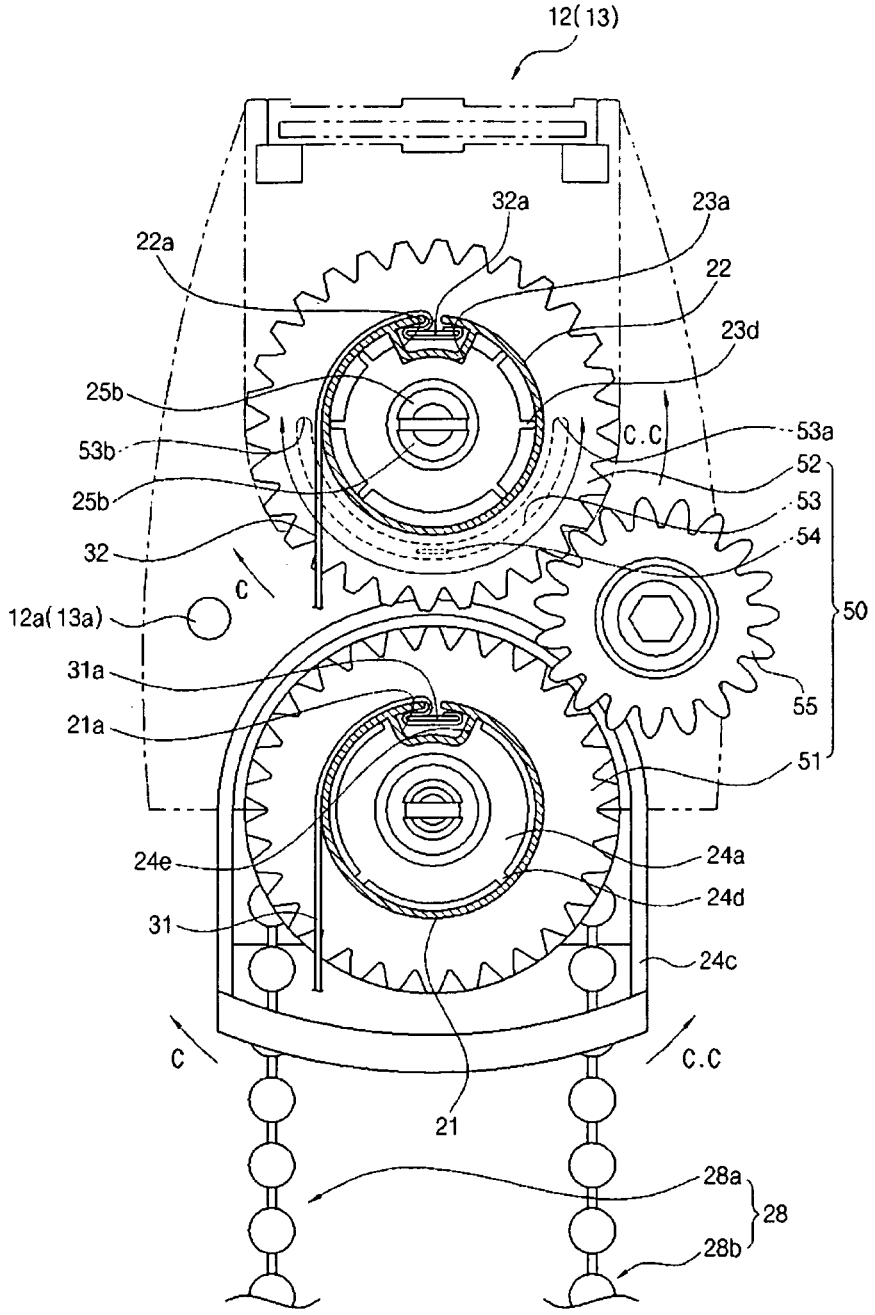
FIG. 4 is a sectional view as viewed along arrow B in FIG. 1.

First, when the front portion 28*a* of the driving string 28 in FIG. 4 is pulled down, the winding driver 24 and the first winding bar 21 rotate counterclockwise (in the direction of arrow C.C in FIG. 4) and the driving gear 51 rotates along with the first winding bar 21 (in the direction of arrow C.C in FIG. 4). When the rotating power of the driving gear 51 is transmitted to the driven gear 52 through the intermediate gear 55, the driving gear 51 and the driven gear 52 rotate in the same direction (in the direction of arrow C.C in FIG. 4). On the other hand, when the intermediate gear 55 is not disposed, the driven gear 52 rotates in the opposite direction of the driving gear 51.

Figure 6:
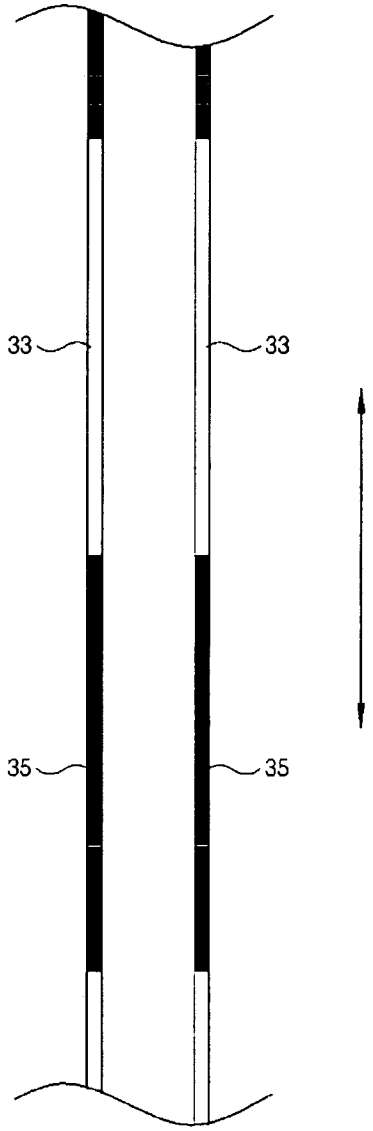
FIG. 6 is a partial sectional view illustrating a state where transparent portions and opaque portions of the first and second screens according to the embodiment of the invention are matched with each other.

When the driven gear 52 rotates and the clutch protrusion 54 is being guided in the circumferential portion a of the clutch groove 53, the driven gear 52 is not bound to the second winding bar 22 and thus the second winding bar 22 does not rotate. Accordingly, only the first screen 31 is unwound from the first winding bar 21 and moves down, whereby the transparent portions 33 and the opaque portions 35 of the first screen 31 can be matched with the transparent portions 33 and the opaque portions 35 of the second screen 32 as shown in FIG. 6. That is, by moving up and down the first screen 31 with only the driving of the first winding bar 21, it is possible to perform the brightness adjusting function of the first and second screens 31 and 32.

When the clutch protrusion 54 comes in contact with one end portion 53*b* of the clutch groove 53 with the rotation of the driven gear 52, the second winding bar 22 to which the clutch protrusion 54 is fixed is bound to the driven gear 52 and rotates in the rotation direction of the driven gear 52.

Figure 5:
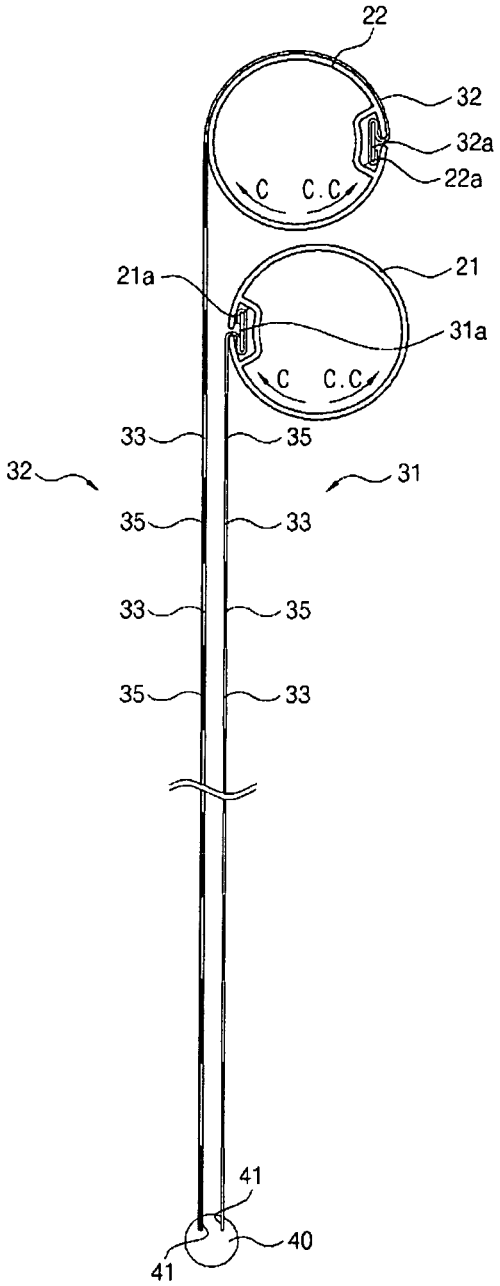
FIG. 5 is a diagram illustrating a state where first and second screens of the roll blind according to the embodiment are unwound.

In this way, when the second winding bar 22 rotates along with the first winding bar 21, the second screen 32 and the first screen 31 are individually unwound from the second winding bar 22 and the first winding bar 21, respectively, and move down as shown in FIG. 5.

Then, when the rear portion 28*b* of the driving string 28 in FIG. 4 is pulled down, the winding driver 24 and the first winding bar 21 rotate together clockwise (in the direction of arrow C in FIG. 4) and the driving gear 51 rotates along with the first winding bar 21 (in the direction of arrow C in FIG. 4). When the rotating power of the driving gear 51 is transmitted to the driven gear 52 through the intermediate gear 55, the driving gear 51 and the driven gear 52 rotate in the same direction (in the direction of arrow C in FIG. 4). On the other hand, when the intermediate gear 55 is not disposed, the driven gear 52 rotates in the opposite direction of the driving gear 51.

When the driven gear 52 rotates and the clutch protrusion 54 is being guided in the circumferential portion a of the clutch groove 53, the driven gear 52 is not bound to the second winding bar 22 (that is, the driven gear 52 is unbound from the second winding bar 22) and thus the second winding bar 22 does not rotate. Accordingly, only the first screen 31 is wound on the first winding bar 21 and moves up, whereby the transparent portions 33 and the opaque portions 35 of the first screen 31 can be matched with the transparent portions 33 and the opaque portions 35 of the second screen 32 as shown in FIG. 6. That is, by moving up and down the first screen 31 with only the driving of the first winding bar 21, it is possible to perform the brightness adjusting function of the first and second screens 31 and 32.

When the clutch protrusion 54 comes in contact with one end portion 53*a* of the clutch groove 53 with the rotation of the driven gear 52, the second winding bar 22 to which the clutch protrusion 54 is fixed is bound to the driven gear 52 and rotates along with the driven gear 52 (in the direction of arrow C in FIG. 4).

Figure 7:
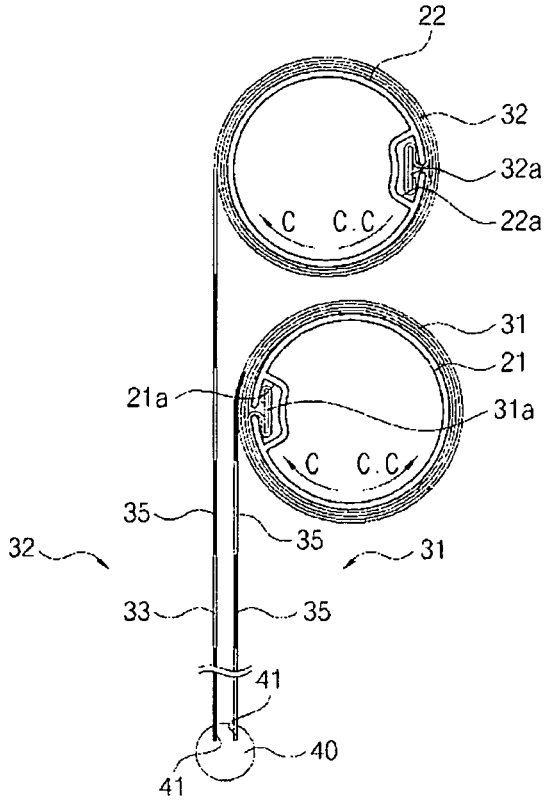
FIG. 7 is a diagram illustrating a state where the first and second screens of the roll blind according to the embodiment are wound.

In this way, when the second winding bar 22 rotates along with the first winding bar 21, the second screen 32 and the first screen 31 are individually wound on the second winding bar 22 and the first winding bar 21, respectively, and move up as shown in FIG. 7.

According to the above-mentioned configuration, since the first and second screens 31 and 32 are individually wound on or unwound from the first and second winding bars 21 and 22, respectively, it is possible to rapidly and simply perform the winding and unwinding operations of the screens 31 and 32.

In addition, according to the above-mentioned configuration, since a screen is divided into the first and second screens 31 and 32, it is possible to precisely improve the straightness of the stripe lines of the transparent portions 33 and the opaque portions 35 of the screens 31 and 32, thereby further improving the external appearance.

The invention claimed is:

1. A roll blind comprising:

a supporting frame disposable in a window frame and having a pair of end plates disposed at first and second ends of the supporting frame;

first and second winding bars rotatably disposed in the end plates of the supporting frame;

a winding driver rotationally driving one of the first and second winding bars;

first and second screens coupled to the first and second winding bars, respectively;

a weight bar to which the lower ends of the first and second screens are fixed; and a clutch unit binding and unbinding the first and second winding bars with respect to each other, wherein the clutch unit includes a driving gear fixedly coupled to the winding driver and a driven gear disposed to be bound to and unbound from the second winding bar, wherein an intermediate gear is interposed between the driving gear and the driven gear, and wherein the driven gear has an arc-like clutch groove formed in one surface thereof, the clutch groove has first and second end portions, the second winding bar has a clutch protrusion, the driven gear is selectively bound to or unbound from the second winding bar by guiding the clutch protrusion in the clutch groove and bringing the clutch protrusion into selective contact with the first and second end portions of the clutch groove, and wherein during rotation of said one of the first and second winding bars in opposite directions by the winding driver, the first and second winding bars are simultaneously rotated in a first direction when the clutch protrusion is in contact with the first end portion of the clutch groove and in an opposite direction when the clutch protrusion is in contact with the second end portion of the clutch groove.

2. The roll blind according to claim 1, wherein the winding driver is disposed at one end of the first winding bar, the winding driver rotates along with the first winding bar, the winding driver includes a small-diameter portion and a large-diameter portion, the small-diameter portion is inserted and coupled to an inner circumference of the first winding bar, and a driving string is wound on an outer circumferential surface of the large-diameter portion.

3. The roll blind according to claim 1, wherein the first and second screens each have alternating opaque and transparent portions extending parallel to the supporting frame, and the extent of vertical overlap between the opaque portions of second screen and the transparent portions of the first screen varies in relation to the position of the clutch protrusion in the clutch groove.

4. The roll blind according to claim 3, wherein the opaque portions of the second screen fully overlap the transparent portions of the first screen when the clutch protrusion is in contact with one of the first and second end portions of the clutch groove, and the transparent portions of the second screen fully overlap the transparent portions of the first screen when the clutch protrusion is in contact with the other of the first and second end portions of the clutch groove.

5. The roll blind according to claim 1, wherein a rotating member is disposed in an inner circumference of the second winding bar, the rotating member rotates along with the second winding bar, a fixed member is disposed inside the rotating member, and the fixed member rotatably supports the rotating member.

6. The roll blind according to claim 5, wherein an elastic member providing elastic force in a circumferential direction to the rotating member is disposed between the rotating member and the fixed member.

7. The roll blind according to claim 6, wherein the rotating member includes first and second rotating members, the second rotating member is inserted into the first rotating member, and the elastic member includes a torsion portion wound on the outer circumferential surface of the fixed member and elastic legs disposed at both ends of the torsion portion and contactable with the second rotating member.

8. A roll blind comprising:

a pair of end plates;

first and second winding bars rotatably supported between the end plates in parallel relationship;

first and second screens coupled to the first and second winding bars for winding onto and unwinding from the first and second winding bars, respectively;

a winding driver for rotationally driving the first winding bar;

a clutch for coupling and decoupling the second winding bar with respect to the first winding bar, the clutch including a protrusion that commonly rotates with one of the first and second winding bars and is engageable with arcuately spaced apart first and second abutments that commonly rotate with the other one of the first and second winding bars; and wherein during rotation of the first winding bar in opposite directions by the winding driver, the first and second winding bars are simultaneously rotated in a first direction when the protrusion is in contact with the first abutment and in an opposite direction when the clutch protrusion is in contact with the second abutment, and wherein the second winding bar is not rotated during movement of the protrusion between the first and second abutments.

9. The roll blind according to claim 8, further comprising a weight bar to which the lower ends of the first and second screens are fixed.

10. The roll blind according to claim 8, wherein the first and second screens each have alternating opaque and transparent portions extending parallel to the first and second winding bars, and the extent of vertical overlap between the opaque portions of second screen and the transparent portions of the first screen varies in relation to the position of the protrusion relative the first and second abutments.

11. The roll blind according to claim 10, wherein the opaque portions of the second screen fully overlap the transparent portions of the first screen when the protrusion is in contact with one of the first and second abutments, and the transparent portions of the second screen fully overlap the transparent portions of the first screen when the protrusion is in contact with the other of the first and second abutments.

* * * * *